US010909800B2

(12) United States Patent
Tran et al.

(10) Patent No.: US 10,909,800 B2
(45) Date of Patent: Feb. 2, 2021

(54) GAMING MACHINE HAVING INSERTABLE BONUS SYMBOLS VIA PLAYER SELECTABLE DIRECTION AND SPEED

(71) Applicant: Aristocrat Technologies Australia Pty Limited, North Ryde (AU)

(72) Inventors: Dinh Toan Tran, Wetherill Park (AU); Oliver Crispino, Rosemeadow (AU); Erika Degens, Epping (AU)

(73) Assignee: Aristocrat Technologies Australia Pty Limited, North Ryde (AU)

( * ) Notice: Subject to any disclaimer, the term of this patent is extended or adjusted under 35 U.S.C. 154(b) by 0 days.

(21) Appl. No.: 16/138,645

(22) Filed: Sep. 21, 2018

(65) Prior Publication Data

US 2019/0096165 A1 Mar. 28, 2019

(30) Foreign Application Priority Data

Sep. 28, 2017 (AU) ..... 2017903932

(51) Int. Cl.
*G07F 17/32* (2006.01)
*G07F 17/34* (2006.01)

(52) U.S. Cl.
CPC ..... *G07F 17/3213* (2013.01); *G07F 17/3209* (2013.01); *G07F 17/3258* (2013.01); *G07F 17/3267* (2013.01); *G07F 17/34* (2013.01)

(58) Field of Classification Search
CPC ..... G07F 17/3213; G07F 17/3209; G07F 17/3258; G07F 17/3267; G07F 17/34
See application file for complete search history.

(56) References Cited

U.S. PATENT DOCUMENTS 6,059,658 A * 5/2000 Mangano ..... A63F 5/04 463/16
2013/0053123 A1* 2/2013 Nicely ..... G07F 17/326 463/20
2015/0087403 A1* 3/2015 Castro ..... G07F 17/3209 463/25
2015/0287264 A1 10/2015 De Viveiros Ortiz

* cited by examiner

*Primary Examiner* — Werner G Garner
(74) *Attorney, Agent, or Firm* — McAndrews, Held & Malloy, Ltd.

(57) ABSTRACT

A gaming machine having a game controller, a display, and a player interface. The game controller generates a game state to be displayed. The display also displays an object outside of the game state to be moved into a location within the game state. The player interface receives a player selection of a direction or a speed to move the object into the location to effect a change in the game state.

16 Claims, 13 Drawing Sheets

GAMING MACHINE HAVING INSERTABLE BONUS SYMBOLS VIA PLAYER SELECTABLE DIRECTION AND SPEED

RELATED APPLICATIONS

This application claims priority to Australian Patent Application No. 2017903932, having a filing date of Sep. 28, 2017, which is incorporated herein by reference in its entirety.

BACKGROUND

Electronic gaming machines ("EGMs") or gaming devices provide a variety of wagering games such as slot games, video poker games, video blackjack games, roulette games, video bingo games, keno games and other types of games that are frequently offered at casinos and other locations. Play on EGMs typically involves a player establishing a credit balance by inputting money, or another form of monetary credit, and placing a monetary wager (from the credit balance) on one or more outcomes of an instance (or single play) of a primary or base game. In many games, a player may qualify for secondary games or bonus rounds by attaining a certain winning combination or triggering event in the base game. Secondary games provide an opportunity to win additional game instances, credits, awards, jackpots, progressives, etc. Awards from any winning outcomes are typically added back to the credit balance and can be provided to the player upon completion of a gaming session or when the player wants to "cash out."

"Slot" type games are often displayed to the player in the form of various symbols arrayed in a row-by-column grid or matrix. Specific matching combinations of symbols along predetermined paths (or paylines) through the matrix indicate the outcome of the game. The display typically highlights winning combinations/outcomes for ready identification by the player. Matching combinations and their corresponding awards are usually shown in a "pay-table" which is available to the player for reference. Often, the player may vary his/her wager to include differing numbers of paylines and/or the amount bet on each line. By varying the wager, the player may sometimes alter the frequency or number of winning combinations, frequency or number of secondary games, and/or the amount awarded.

Typical games use a random number generator (RNG) to randomly determine the outcome of each game. The game is designed to return a certain percentage of the amount wagered back to the player (RTP=return to player) over the course of many plays or instances of the game. The RTP and randomness of the RNG are critical to ensuring the fairness of the games and are therefore highly regulated. Upon initiation of play, the RNG randomly determines a game outcome and symbols are then selected which correspond to that outcome. Notably, some games may include an element of skill on the part of the player and are therefore not entirely random.

BRIEF SUMMARY

According to an aspect of the present disclosure, there is provided a method of gaming performed by a gaming machine, comprising the steps of: generating a game state on a display comprising one or more screens of the gaming machine; displaying an object separately to the game state on the display; receiving an input from a player of the gaming machine in respect of the object, and determining a second location of the object; displaying an animation of the object moving to the second location; and causing a change of the game state in response to the second location corresponding to a target location.

Optionally, the game state comprises a spinning reel game, and a plurality of reels each comprising one or more symbol display positions is displayed on the display, and the game state comprises an arrangement of symbols wherein there is one symbol for each window. The object may be presented on the same screen simultaneously with the one or more reels before the animation of the object. The object may be presented on a second screen simultaneously with the one or more reels being displayed on a first screen before the animation of the object. The object may be presented on a first screen before the animation of the object and said reels are displayed on the first screen but not until after the initiation of the animation. The target location may be represented by one, or a subset, of the symbols that are available for display in each window. The game state may be changed by replacing the symbol present in a window which is determined to correspond to the second location.

The method may further comprise receiving an initiating input from a player before receiving an input from a player of the gaming machine in respect of the object.

The input optionally includes selection, by the player, of a direction of motion of the object. The input optionally includes selection, by the player, of a strength of motion of the object. Optionally, the display comprises a touch screen, and the input corresponds to the player pressing a portion of the touch screen.

The second location may be determined before completion of the animation. Alternatively, the second location may be determined at the conclusion of the animation.

Optionally, determining the second location comprises a random component. Optionally, the game state is changed by modifying a payout.

According to another aspect of the present disclosure, there is provided a gaming system comprising a game controller, a player interface, and a display comprising at least one screen, wherein the game controller is configured to: generate a game state on the display; display an object separately to the game state on the display; receive an input from a player of the gaming machine in respect of the object, and determining a second location of the object; display an animation of the object moving to the second location; and cause a change of the game state in response to the second location corresponding to a target location.

Optionally, the game state comprises a spinning reel game, and wherein a plurality of reels each comprising one or more symbol display positions is displayed on the display, and wherein the game state comprises an arrangement of symbols wherein there is one symbol for each window. The object may be presented on the same screen simultaneously with the one or more reels before the animation of the object. The object may be presented on a second screen simultaneously with the one or more reels being displayed on a first screen before the animation of the object. The object may be presented on a first screen before the animation of the object and said reels are displayed on the first screen but not until after the initiation of the animation. The target location may be represented by one, or a subset, of the symbols that are available for display in each window. The game state may be changed by replacing the symbol present in a window which is determined to correspond to the second location.

The game controller may be further configured to receive an initiating input from a player before it receives an input from a player of the gaming machine in respect of the object.

The input may include selection, by the player, of a direction of motion of the object. The input may include selection, by the player, of a strength of motion of the object. The display may comprise a touch screen, and the input may corresponds to the player pressing a portion of the touch screen.

The second location may be determined before completion of the animation. Alternatively, the second location may be determined at the conclusion of the animation.

Optionally, determination of the second location comprises a random component. Optionally, the game state is changed by modifying a payout.

According to another aspect of the present disclosure, there is provided a gaming machine comprising a game controller, a player interface, and a display comprising at least one screen, wherein the game controller is configured to: generate a game state on the display; display an object separately to the game state on the display; receive an input from a player of the gaming machine in respect of the object, and determining a second location of the object; display an animation of the object moving to the second location; and cause a change of the game state in response to the second location corresponding to a target location.

As used herein, the word "comprise" or variations such as "comprises" or "comprising" is used in an inclusive sense, i.e. to specify the presence of the stated features but not to preclude the presence or addition of further features in various embodiments of the disclosure.

BRIEF DESCRIPTION OF SEVERAL VIEWS OF THE DRAWINGS

An exemplary embodiment of the disclosure will now be described with reference to the accompanying drawings in which.

DETAILED DESCRIPTION

Figure 1:
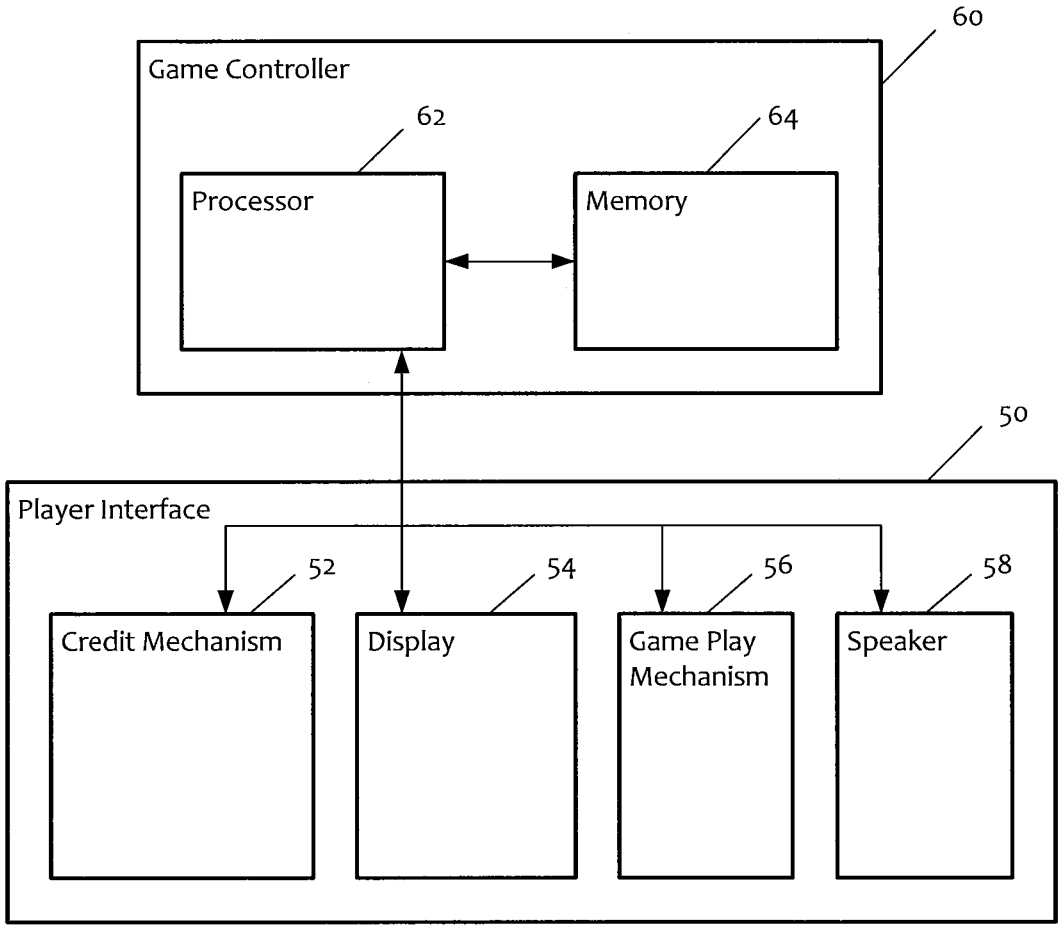
FIG. 1 is a block diagram of the core components of a gaming system.

Referring to the drawings, there is shown a gaming system having a game controller arranged to implement a secondary game after a game result of a primary game.

General Construction of Gaming System

The gaming system can take a number of different forms. In a first form, a stand-alone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand-alone gaming machine mode, "thick client" mode or "thin client" mode depending on the game being played, operating conditions, and so on. Other variations will be apparent to persons skilled in the art.

Irrespective of the form, the gaming system has several core components. At the broadest level, the core components are a player interface 50 and a game controller 60 as illustrated in FIG. 1. The player interface is arranged to enable manual interaction between a player and the gaming system and for this purpose includes the input/output components required for the player to enter instructions to play the game and observe the game outcomes.

Components of the player interface may vary from embodiment to embodiment but will typically include a credit mechanism 52 to enable a player to input credits and receive payouts, one or more displays 54, a game play mechanism 56 including one or more input devices that enable a player to input game play instructions (e.g. to place a wager), and one or more speakers 58.

The game controller 60 is in data communication with the player interface and typically includes a processor 62 that processes the game play instructions in accordance with game play rules and outputs game play outcomes to the display. Typically, the game play rules are stored as program code in a memory 64 but can also be hardwired. Herein the term "processor" is used to refer generically to any device that can process game play instructions in accordance with game play rules and may include: a microprocessor, microcontroller, programmable logic device or other computational device, a general purpose computer (e.g. a PC) or a server. That is a processor may be provided by any suitable logic circuitry for receiving inputs, processing them in accordance with instructions stored in memory and generating outputs (for example on the display). Such processors are sometimes also referred to as central processing units (CPUs). Most processors are general purpose units, however, it is also know to provide a specific purpose processor using an application specific integrated circuit (ASIC) or a field programmable gate array (FPGA).

Figure 2:
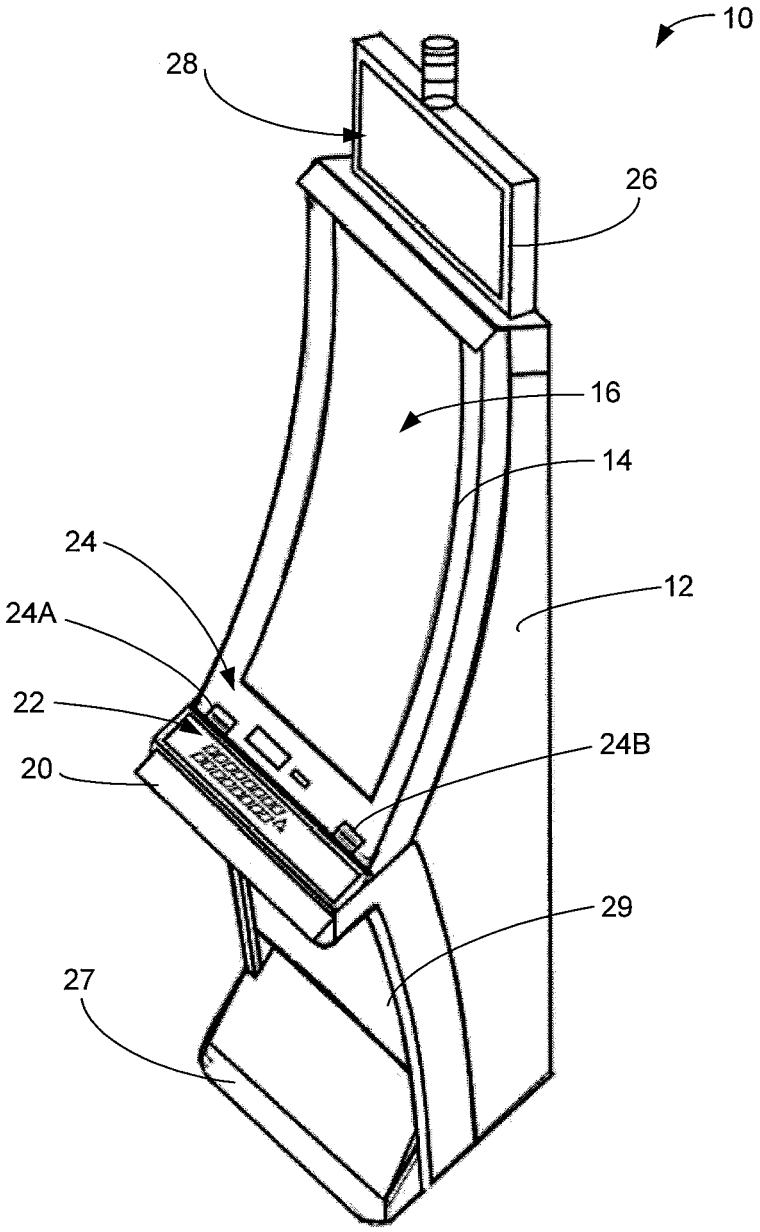
FIG. 2 is a perspective view of a stand-alone gaming machine.

A gaming system in the form of a standalone gaming machine 10 is illustrated in FIG. 2. The gaming machine 10 includes a console 12 having a display 14 on which are displayed representations of a game 16 that can be played by a player. A mid-trim 20 of the gaming machine 10 houses a bank of buttons 22 for enabling a player to interact with the gaming machine, in particular during game play. The mid-trim 20 also houses a credit input mechanism 24 which in this example includes a coin input chute 24A and a bill collector 24B. Other credit input mechanisms may also be employed, for example, a card reader for reading a smart card, debit card or credit card. Other gaming machines may configure for ticket in such that they have a ticket reader for reading tickets having a value and crediting the player based on the face value of the ticker. A player marketing module (not shown) having a reading device may also be provided for the purpose of reading a player tracking device, for example as part of a loyalty program. The player tracking device may be in the form of a card, flash drive or any other portable storage medium capable of being read by the reading device. In some embodiments, the player marketing module may provide an additional credit mechanism, either by transferring credits to the gaming machine from credits stored on the player tracking device or by transferring credits from a player account in data communication with the player marketing module.

A top box 26 may carry artwork 28, including for example pay tables and details of bonus awards and other information or images relating to the game. Further artwork and/or information may be provided on a front panel 29 of the console 12. A coin tray 27 is mounted beneath the front panel 29 for dispensing cash payouts from the gaming machine 10.

The display 14 shown in FIG. 2 is in the form of a video display unit, particularly a cathode ray tube screen device. Alternatively, the display 14 may be a liquid crystal display, plasma screen, any other suitable video display unit, or the visible portion of an electromechanical device. The top box 26 may also include a display, for example a video display unit, which may be of the same type as the display 14, or of a different type.

Figure 3:
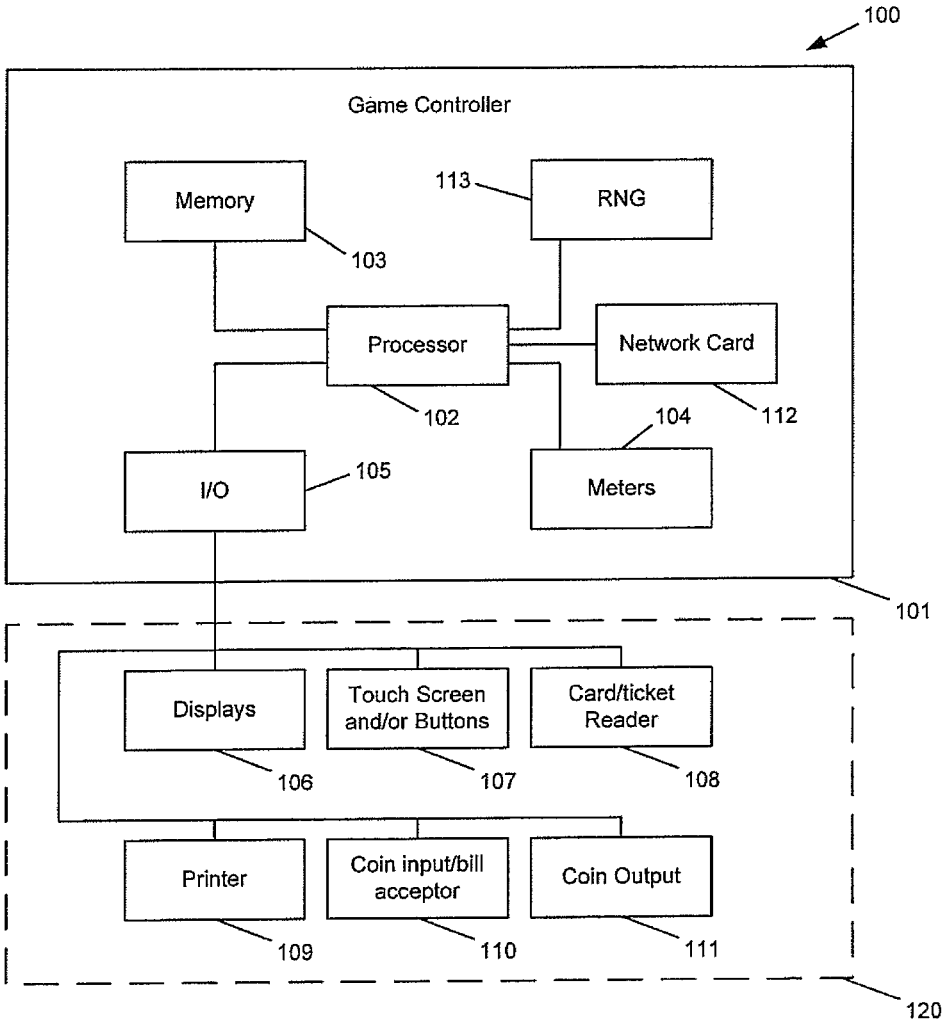
FIG. 3 is a block diagram of the functional components of a gaming machine.

FIG. 3 shows a block diagram of operative components of a typical gaming machine which may be the same as or different to the gaming machine of FIG. 2.

The gaming machine 100 includes a game controller 101 having a processor 102 mounted on a circuit board. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 including one or more displays 106, a touch screen and/or buttons 107 (which provide a game play mechanism), a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation. For example, while buttons or touch screens are typically used in gaming machines to allow a player to place a wager and initiate a play of a game any input device that enables the player to input game play instructions may be used. For example, in some gaming machines a mechanical handle is used to initiate a play of the game. Persons skilled in the art will also appreciate that a touch screen can be used to emulate other input devices, for example, a touch screen can display virtual buttons which a player can "press" by touching the screen where they are displayed.

In addition, the gaming machine 100 may include a communications interface, for example a network card 112. The network card may, for example, send status information, accounting information or other information to a bonus controller, central controller, server or database and receive data or commands from the bonus controller, central controller, server or database. In embodiments employing a player marketing module, communications over a network may be via player marketing module—i.e. the player marketing module may be in data communication with one or more of the above devices and communicate with it on behalf of the gaming machine.

Figure 4:
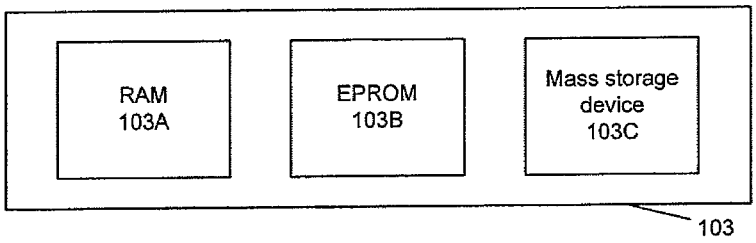
FIG. 4 is a schematic diagram of the functional components of a memory.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices such as one or more displays 106, touch screen and/or buttons 107, card and/or ticket reader 108, printer 109, bill acceptor and/or coin input mechanism 110, coin output mechanism 111, to be provided remotely from the game controller 101.

Figure 5:
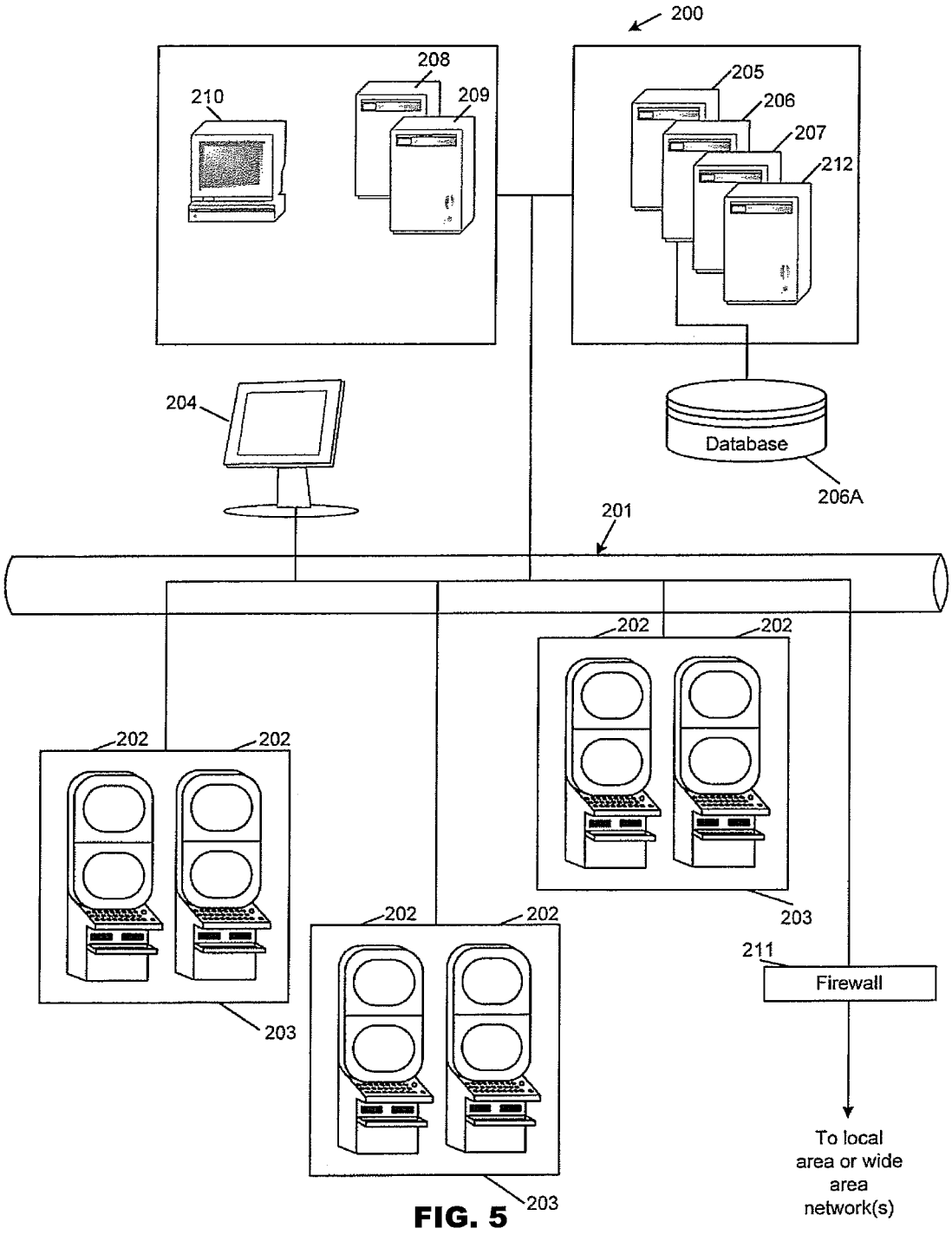
FIG. 5 is a schematic diagram of a network gaming system.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5, are connected to the network 201. The gaming machines 202 provide a player operable interface and may be the same as the gaming machines 10, 100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to the network 201. For example, the displays 204 may be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by the gaming machines 202 in a database 206A. Typically, if the gaming system enables players to participate in a Jackpot game, a Jackpot server 207 will be provided to perform accounting functions for the Jackpot game. A loyalty program server 212 may also be provided.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components. Other client/server configurations are possible, and further details of a client/server architecture can be found in WO 2006/052213 and PCT/SE2006/000559, the disclosures of which are incorporated herein by reference.

Servers are also typically provided to assist in the administration of the gaming system 200, including for example a gaming floor management server 208, and a licensing server 209 to monitor the use of licenses relating to particular games. An administrator terminal 210 is provided to allow an administrator to run the network 201 and the devices connected to the network.

The gaming system 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of game servers could be provided to run different games or a single game server may run a plurality of different games as required by the terminals.

Further Detail of Gaming System

The game controller 60 is configured to implement a primary game and a secondary game. The primary game typically takes the form of a spinning reel game, although other primary games are envisaged. An example of a primary game is that marketed under the trade name "Buffalo" by Aristocrat Leisure Industries Pty Ltd.

The player operates the game play mechanism 56 to specify a wager and hence the win entitlement which will be evaluated for this play of the primary game and initiates a play of the primary game. Persons skilled in the art will appreciate that a player's win entitlement will vary between plays of the primary game dependent on player selections. In most spinning reel games, it is typical for the player's entitlement to be affected by the amount they wager and selections they make (i.e. the nature of the wager). For example, a player's win entitlement may be based on how many lines they play in each primary game—e.g. a minimum of one line up to the maximum number of lines allowed by the primary game (noting that not all permutations of win lines may be available for selection) and how much they wager per line. Such win lines are typically formed by a combination of symbol display positions, one from each reel, the symbol display positions being located relative to one another such that they form a line.

In many primary games, the player's win entitlement is not strictly limited to the lines they have selected, for example, "scatter" pays are awarded independently of a player's selection of pay lines and are an inherent part of the win entitlement.

Persons skilled in the art will appreciate that in other embodiments, the player may obtain a win entitlement by selecting a number of reels to play and an amount to wager per reel. Such primary games are marketed under the trade name "Reel Power" by Aristocrat Leisure Industries Pty Ltd. The selection of the reel means that each displayed symbol of the reel can be substituted for a symbol at one or more designated display positions. In other words, all symbols displayed at symbol display positions corresponding to a selected reel can be used to form symbol combinations with symbols displayed at a designated, symbol display positions of the other reels. For example, if there are five reels and three symbol display positions for each reel such that the symbol display positions comprise three rows of five symbol display positions, the symbols displayed in the center row are used for non-selected reels. As a result, the total number of ways to win is determined by multiplying the number of active display positions of each reels, the active display positions being all display positions of each selected reel and the designated display position of the non-selected reels. As a result for five reels and fifteen display positions there are 243 ways to win.

In other embodiments a player win entitlement may be affected by purchasing access to particular pay tables—e.g. a first bet amount entitles the player to wins including cherries and a second amount entitles them to wins including plums.

A game round of a primary game involves at least one of the reels being "spun"—e.g. new symbols of the reels are selected for display at the display positions and the reel is either physically or virtually spun to a stop. Persons skilled in the art will appreciate that there may be more than one game round in a play of a primary game of a gaming machine such as is the case when a series of free spins is awarded. The outcome of a game round may be no win, a win (for example from a winning combination of symbols), a contribution towards a win accrued over a plurality of game rounds, a trigger condition occurring etc. Typically, a win will result in some form of award being made such as an award of credits.

Secondary Game

Figure 6A:
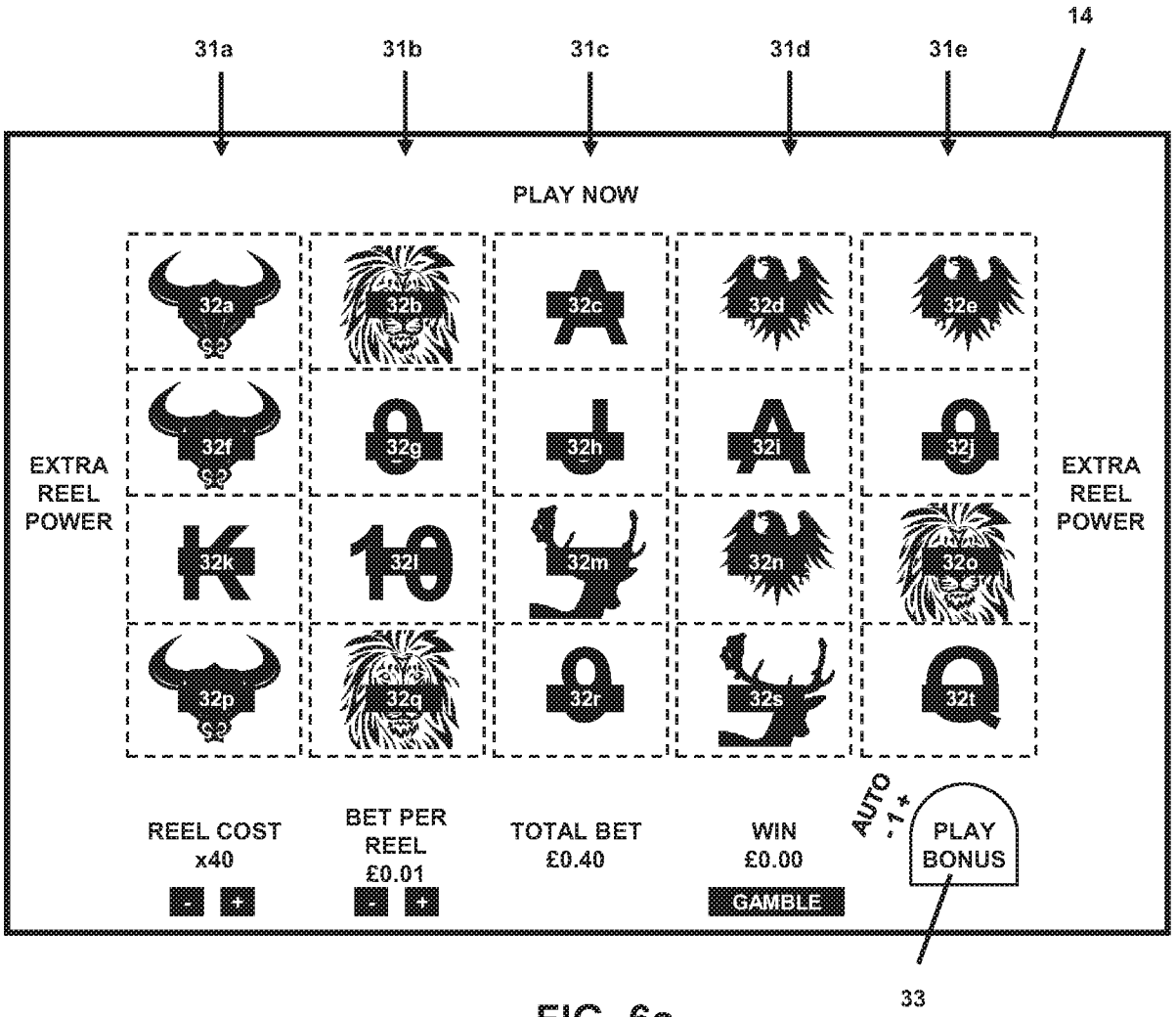
FIG. 6*a* shows a game state as a result of play of a primary game.

FIG. 6*a* shows an example of the presentation of a game round on a display 106. In the example, an initial outcome of the game round has been determined. The initial outcome may take on any of the available results. The display 106 therefore displays one or more reels 31 (five reels 31*a*-31*e* are shown) which have been spun to a stop. Each of the stopped reels 31 displays a number of symbols in windows 32 (shown in broken lines), which are typically determined through a calculation of the game controller 60 (and will typically utilize a random number generator), as already described. The windows 32 may or may not be visually demarcated. In FIG. 6*a*, there are a total of twenty windows 32*a*-32*t*.

Figure 6B:
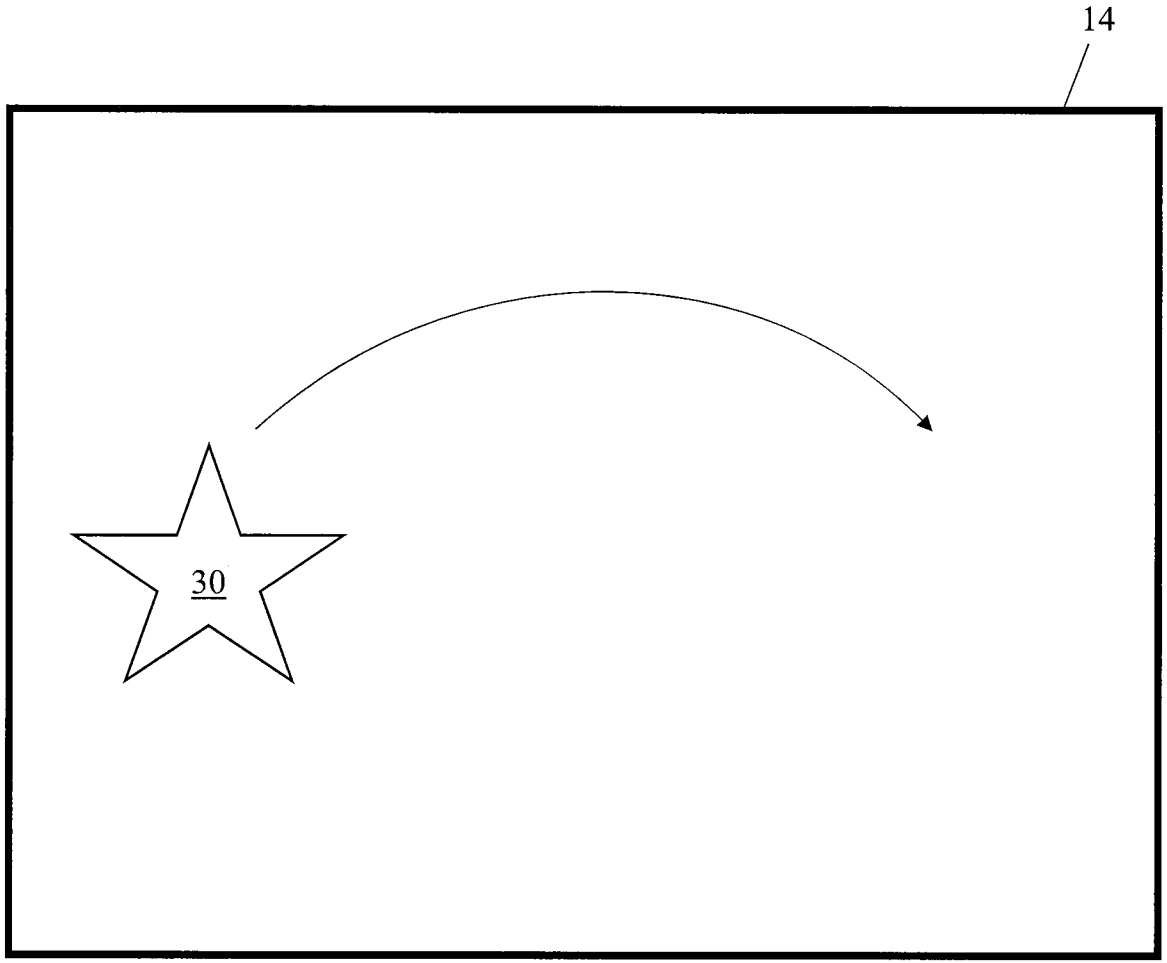
FIG. 6*b* shows an object and motion of animation of the object.

The game controller 60 is configured to enable play of a secondary game, utilizing a secondary gameplay mechanism. The secondary gameplay mechanism allows a player an opportunity to modify the outcome of the game round. The game controller 60 determines the presence of an activation action. Referring to FIG. 6*b*, in response to the activation action, an animation is performed whereby an object 30 is moved from a starting position on the display 14 (or a secondary display) to a second position on the display 14 (as indicated by the arrow). The secondary gameplay mechanism is configured to enable a player to have actual or at least apparent control over the location of the second position based on their player input.

An activation action can be an initiating input provided by the player, for example via the player interface 50. In FIG. 6*a*, a touch button 33 is provided enabling play of the secondary game. In a variation, the secondary game is activated automatically in response to a particular event (i.e. the particular event corresponds to the activation action). For example, the particular event may be a probabilistic event: for example, the secondary game may be activated after the completion of a predefined percentage of primary games (such as 10%). Alternatively, the secondary game may be activated after the occurrence of a particular result (or particular results) of the primary game.

Figure 6C:
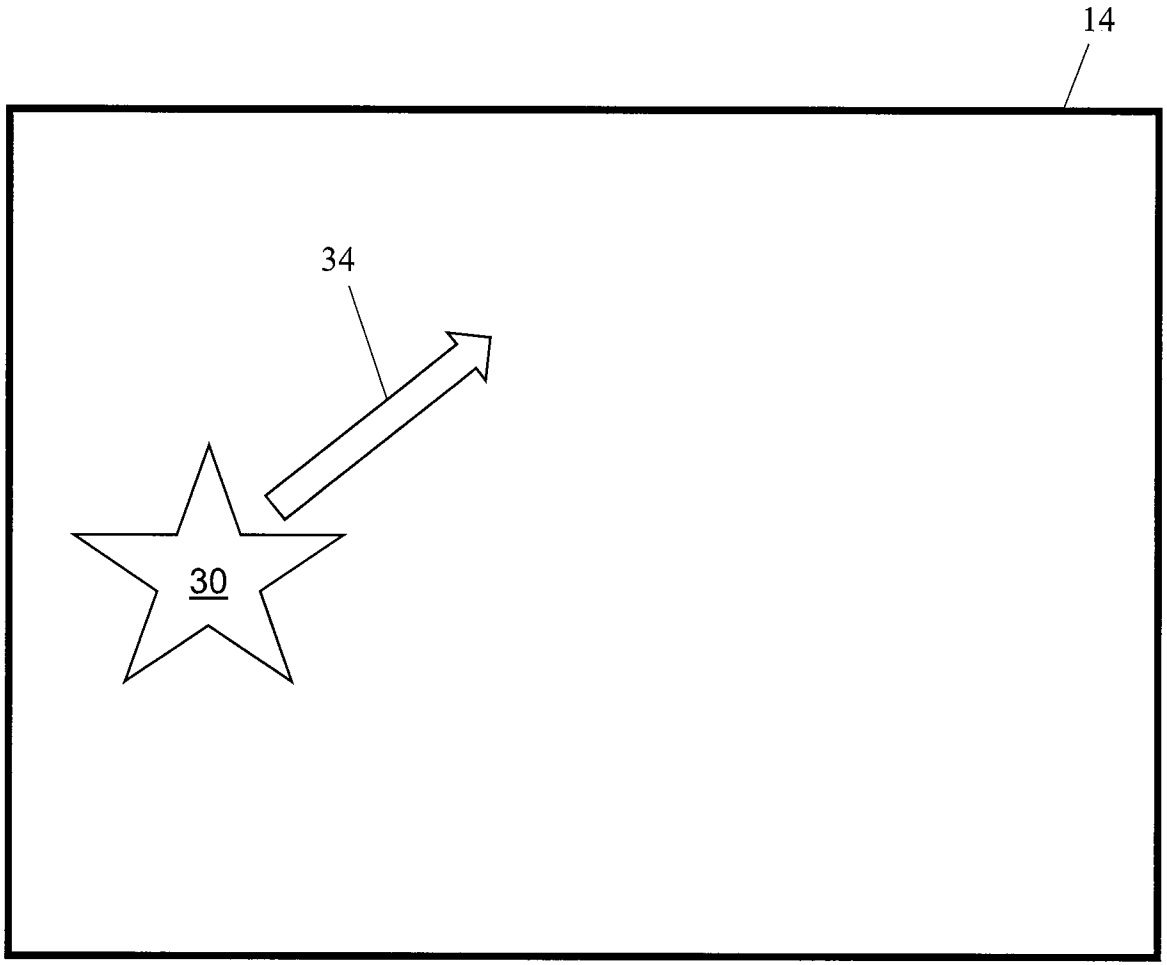
FIG. 6*c* shows selection of a direction of motion of the object.

Referring to FIG. 6*c*, in an embodiment, the player is enabled to select a direction of motion (the arrow 34 indicates the selected direction of motion) for the object 30. In an implementation, the player interacts with a touch-screen of the player interface 50 (which may be the display 14 which also displays the primary game). In another implementation, the player interacts with an input device of the player interface 50 that is not the display 14, for example, one or more buttons or a track pad.

Figure 6D:
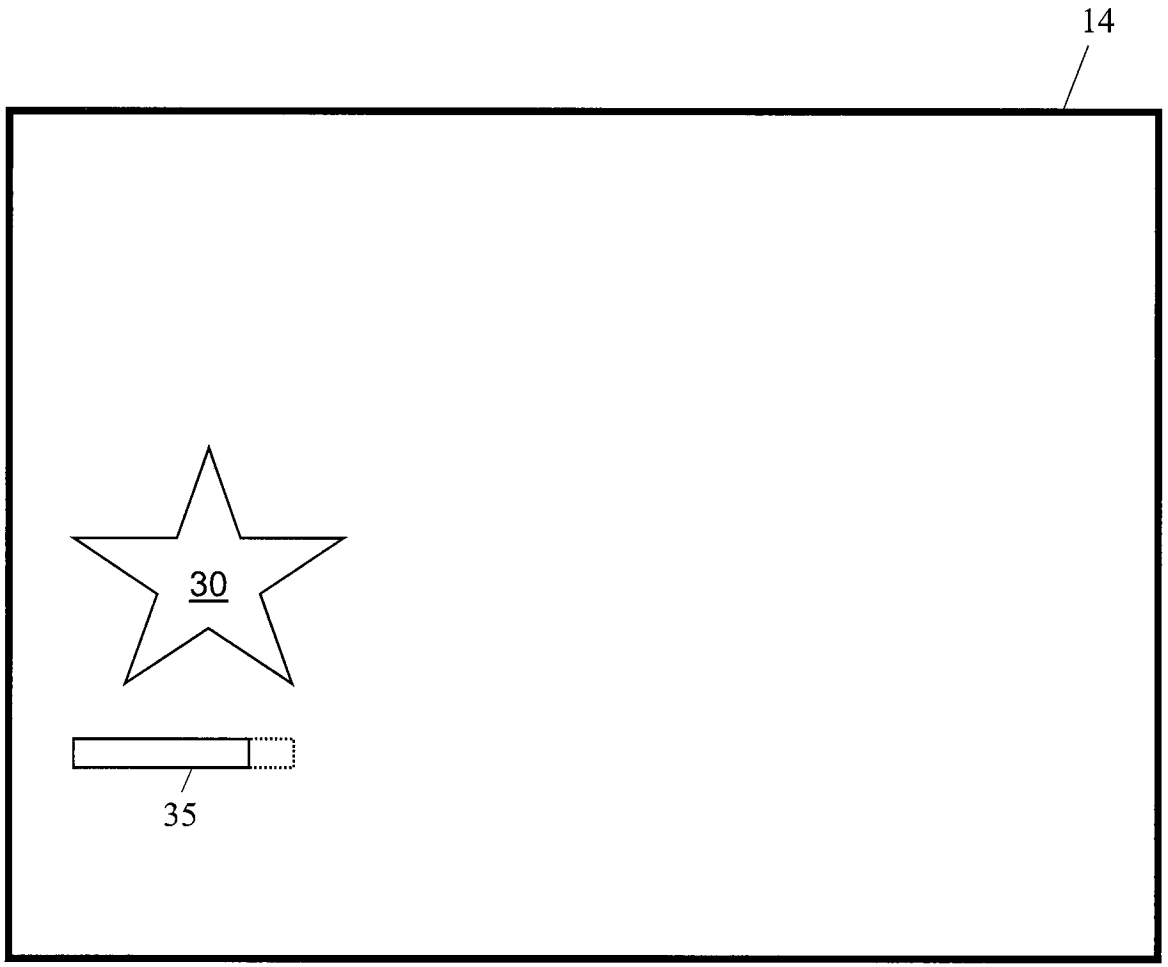
FIG. 6*d* shows selection of a strength of motion of the object.

Referring to FIG. 6*d*, in an embodiment, the player is enabled to select a "strength" of motion (bar 35 indicates the selected strength of motion). The strength of motion may correspond, for example, to an initial apparent speed of movement of the object 30. In an implementation, the player interacts with a touchscreen of the player interface 50 (which may be the display 14 displaying the primary game). In another implementation, the player interacts with an input device of the player interface 50 that is not the display 14, for example, one or more buttons or a track pad.

Figure 6E:
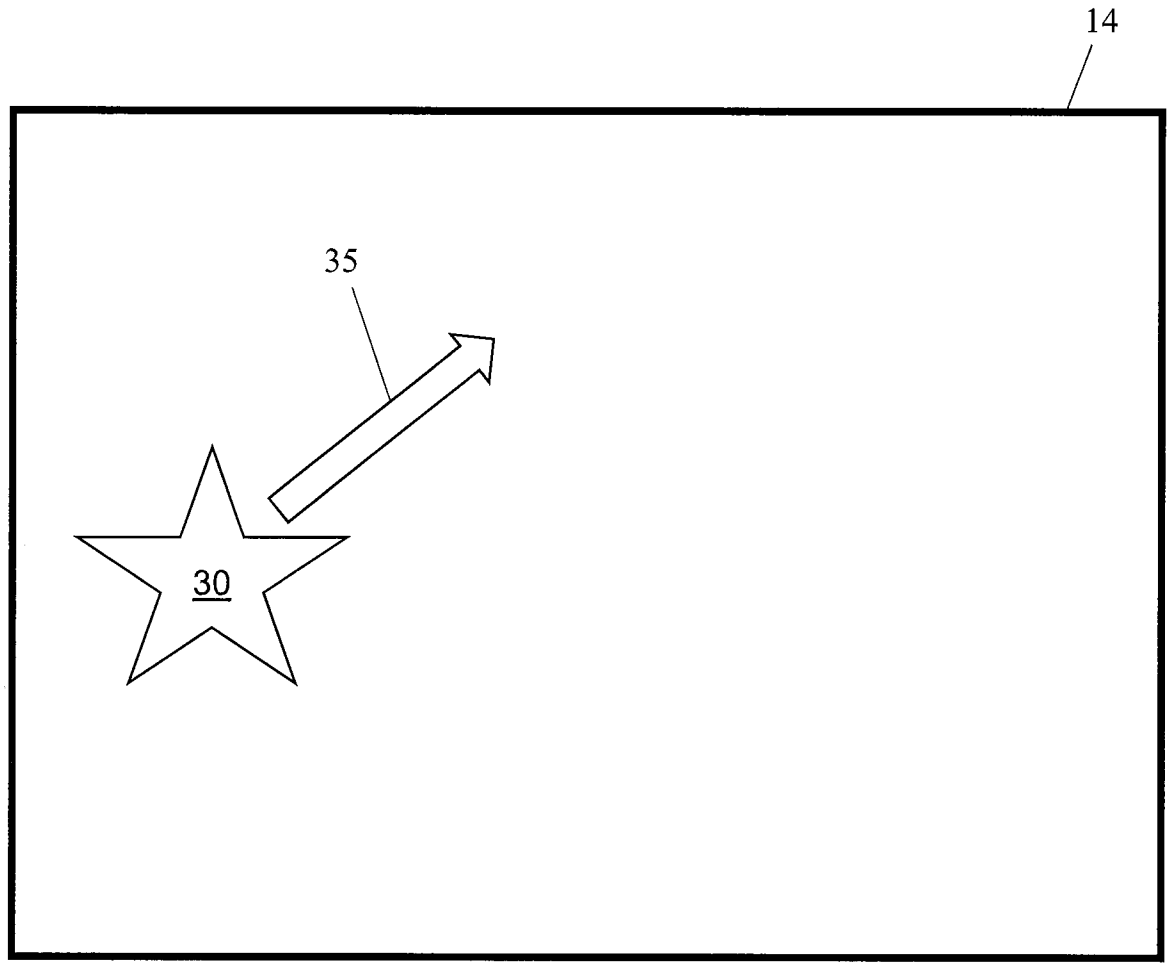
FIG. 6*e* shows selection of a strength of motion and a direction of motion of the object.

In an embodiment, the player is enabled to select both the strength of motion and direction of motion. For example, referring to FIG. 6*e*, the length of arrow 43 indicates the selected strength of motion and the direction of the arrow indicates the selected direction of motion. In a particular implementation, this is implemented using a touch screen of the player interface 50. For example, the direction of motion may be selected by the player touching the touch screen at a position different to the location of the object 30. In this case, the direction of motion is determined as being in a direction towards the reels 31 that passes through both the location on the touch screen of the object 30 and the location being touched by the player. The strength of motion is determined according to the distance between the object 30 (for example, the center of the object 30) and the location on the touch screen being touched by the player. The strength of motion may be linearly proportion to the distance, or there may be some other relationship. Preferably, the strength of motion increases with the distance.

In a variation, one of the strength of motion and direction of motion is determined by the game controller, for example, by being pre-configured by an operator of the gaming machine 10.

Once strength of motion and direction of motion are determined, the game controller 60 determines an animation to present on the display 106. In an embodiment, the animation may include an apparent "flight-like" movement of the object 30 away from the starting position. The object 30 may appear to move at a constant speed or may appear to change speed. Additionally, the direction of motion of the object 30 will typically appear to change during the animation.

Figure 7A:
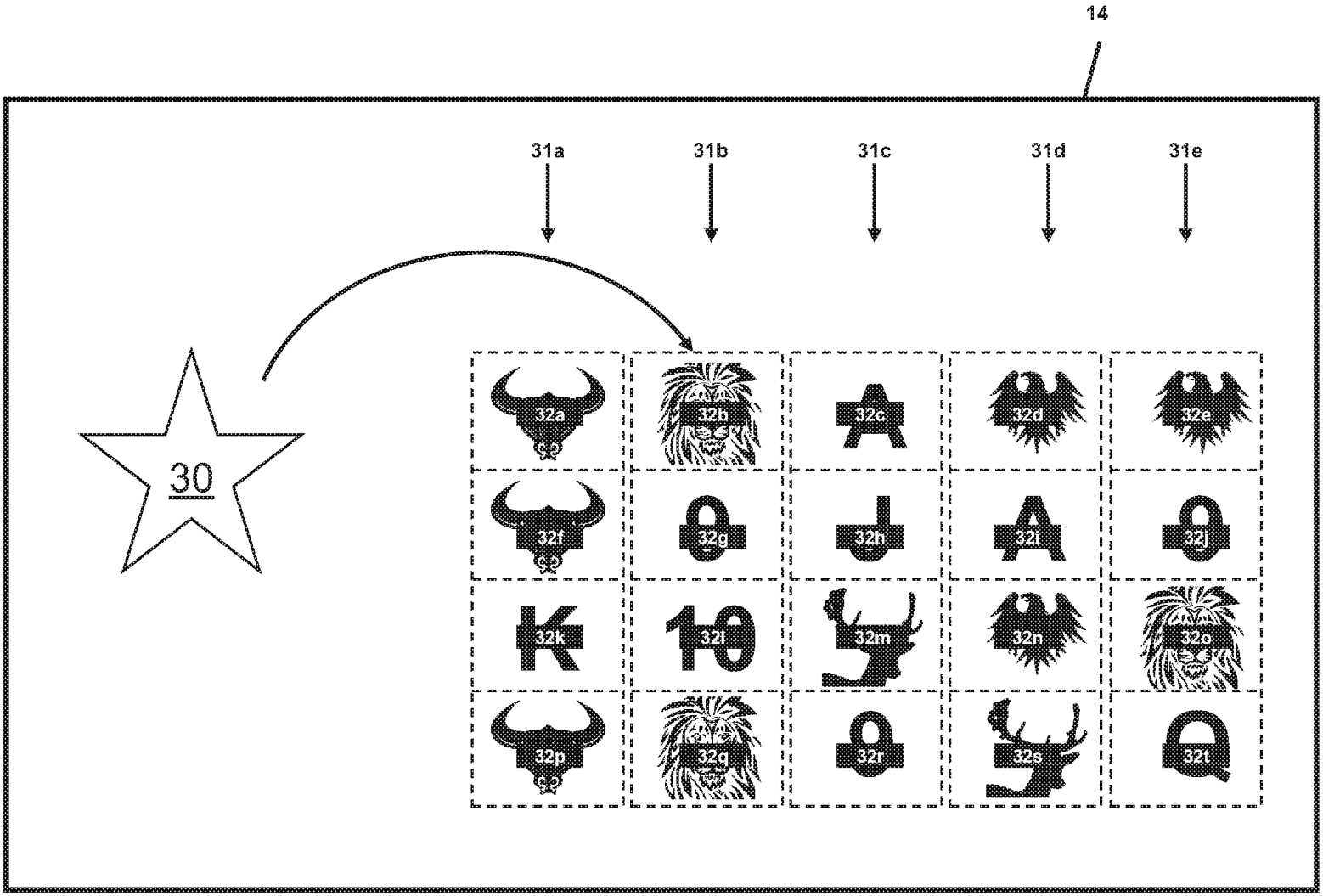
FIG. 7*a* shows the reels and the object on the same screen before an animation.

In an embodiment, as shown in FIG. 7*a*, the object 30 is shown on the display 14 to the left of the reels 31, which are located on the right side of the display 14. Generally, the object 30 may be positioned anywhere on the display 14 that is separate to the reels 31. The display shown in FIG. 7*a* is a "zoomed out" display, where the apparent size of the reels 31 is smaller than during the primary game. Prior to initiation of the secondary game, a zooming effect may be applied wherein the apparent size of the reels 31 decreases and the center of the display 14 appears to move away from the reels 31, revealing the object 30. This enables the display 14 to be utilized for both the primary game, wherein the reels 31 dominate the display area of the display 14, and the secondary game wherein the object 30 is displayed at a starting position a distance from the reels 31.

Figure 7B:
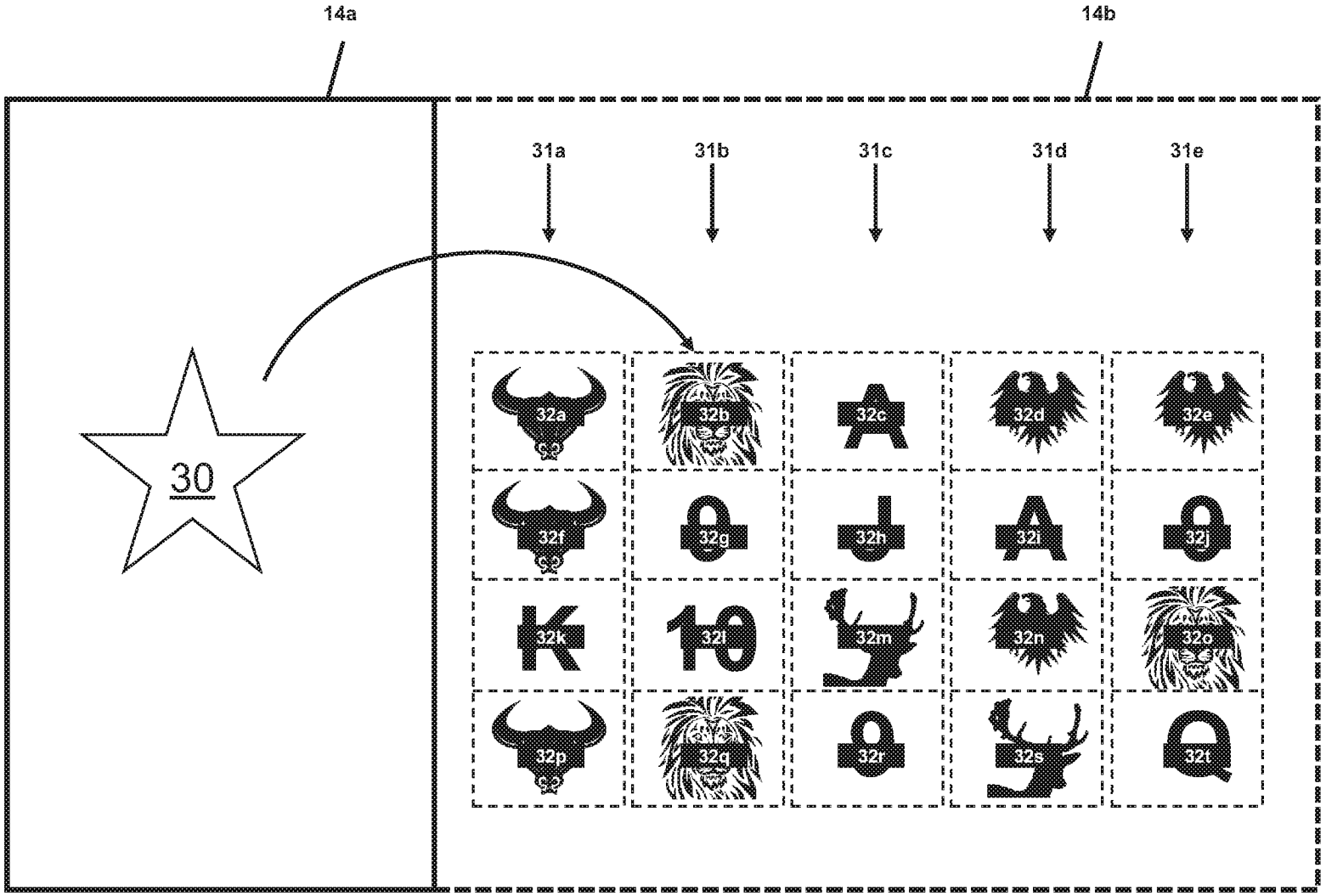
FIG. 7*b* shows the object on a screen before an animation and an indication of the reels to be displayed at the end of the animation.

In an embodiment, as shown in FIG. 7*b*, the object 30 is initially displayed without the reels 31 also being displayed. The reels 31 are understood by the player to be located "off-screen;" that is, outside of the display area of the display 106. For example, a scrolling effect may be applied upon activation of the secondary game whereby the display 14 appears to move away from displaying the reels 31 and moves towards displaying the object 30. Display 14*a* shows the object 30 without the reels 31. However, display 14*b* indicates that the player is aware that the object 30 is "aimed" at the reels which are off-screen (and hence display 14*b* is shown with broken lines).

Figure 7C:
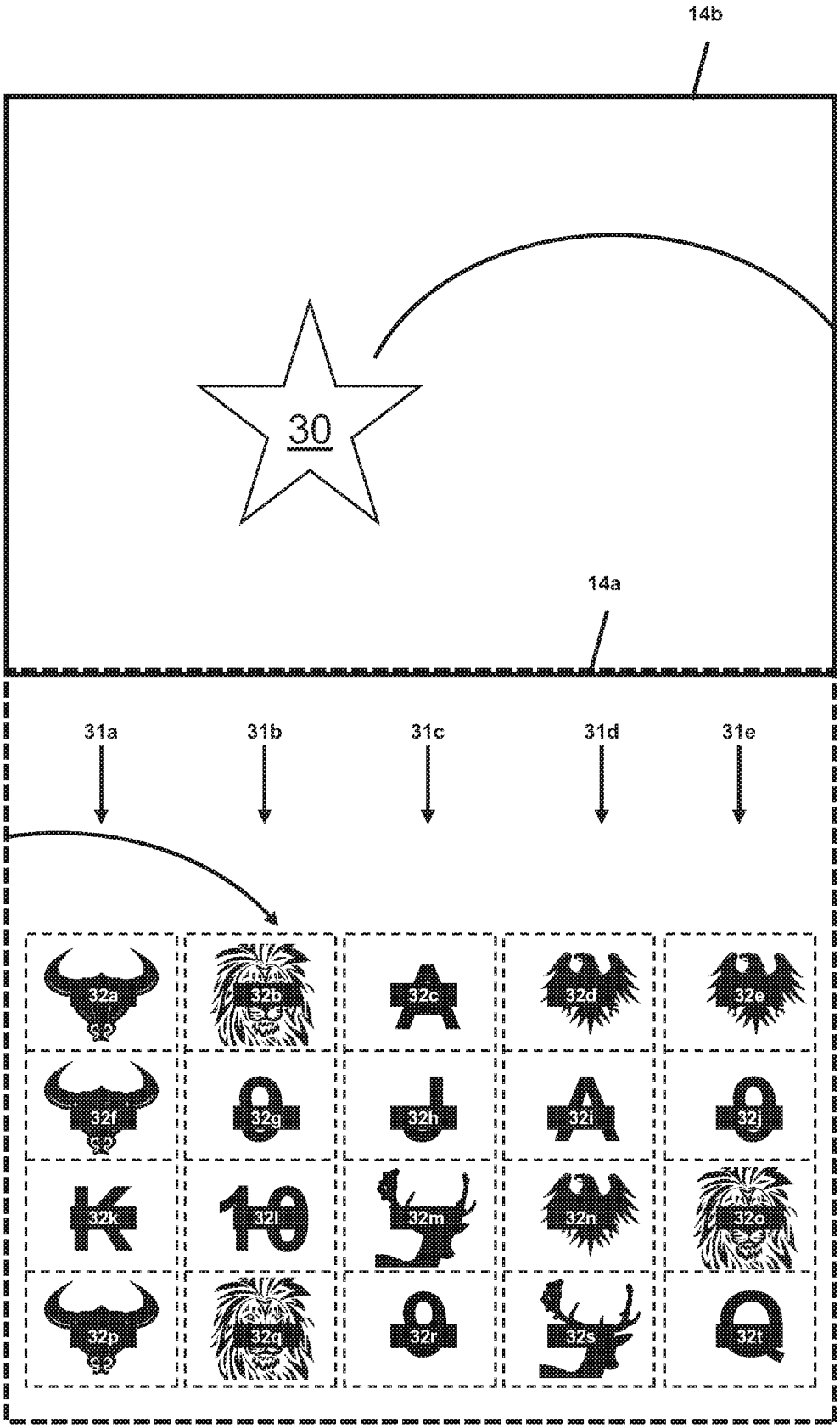
FIG. 7*c* shows the reels and the object on different screens before an animation.

In an embodiment, as shown in FIG. 7*c*, the object 30 is initially displayed on a secondary display 14*b* (in FIG. 7*c*, this is shown above the display 14*a*). The display 14*a* continues to display the reels 31. In this case, the display 14*a* and secondary display 14*b* are "linked" in that the object 30 during the animation appears to move out of the secondary display and into the display 14. Hence, the arrow showing the direction of travel of the object 30 exits the secondary display 14*b* and enters the display 14*a*.

Figure 8:
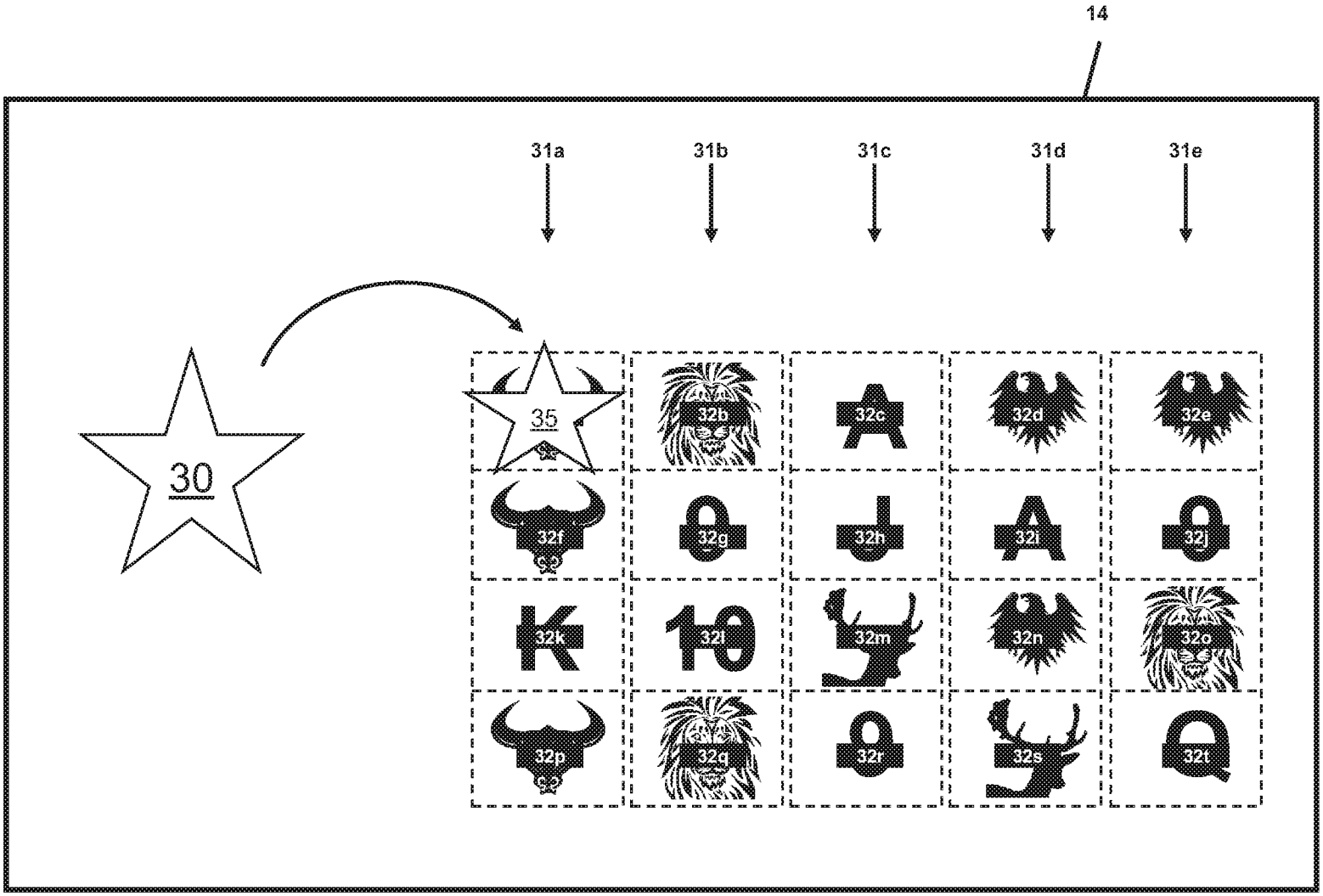
FIG. 8 shows the object moved onto a second location (being a window of a reel) as a result of the animation.

The second position corresponds to a "landing spot" of the object 30, and is indicated by an animation of the object 30 coming to a rest after its motion. The second position can be determined "on the fly" through calculation by the game controller 60 whereby the apparent route of the motion of the object 30, and its landing spot, are determined during the animation of its motion. Referring to FIG. 8, the landing spot is indicated by the landed object 36 (shown in dotted lines).

In an embodiment, the second position is determined based on the player input and substantially before the object 30 apparently arrives at the second location. For example, the game controller 60 can be configured to determine the second location before the animation of the motion of the object 30 is initiated (as determined by the player input).

In an embodiment, the second location is at least partially determined based on determination rules. For example, a determination rule may specify a random component to the determination of the second location.

Upon determining the second location, a check is made as to whether the second location corresponds to one of one or more target locations. The target locations are typically predetermined before the animation of the motion of the object 30, and may correspond to one or more windows of the reels 31. In a particular implementation, where each window 32 corresponds to one of a selection of symbols, it is a subset of these symbols (such as one of the symbols) that corresponds to a target location. Therefore, the effect of the secondary game in this embodiment is that the player is attempting to hit a window 32 with an appropriate symbol, for example, by "landing" the object 30 on one such window 32. Thus, the secondary game gives the appearance of a game of skill as opposed to, for example, a game of pure chance. In FIG. 8, the target symbols correspond to an image of a buffalo, and therefore, windows 32*a*, 32*f*, and 32*p* correspond to target locations.

In an embodiment, if the second location of the object 30 is determined to correspond to a target location, a change of primary game state is initiated. For example, the game state of the primary game state may be changed by modifying a payout of a successful primary game outcome. For example, the payout may be doubled as a result (or any other multiplier may be applied).

In an embodiment, the primary game state is changed by modifying the symbol presented in the window which is associated with the target location. For example, where the symbol is not a winning symbol, it may be changed (for example, via a "spinning" animation) to another symbol. The new symbol may or may not correspond to a winning symbol. In an embodiment, the new symbol is required to correspond to a symbol which increases the total payout of the primary game.

In an embodiment, the animation of the motion of the object 30 is such as to give an appearance that the object 30 has moved in 3-dimensions. For example, the object 30 may appear to move closer to the player for a first portion of the animation and then to move away from the player for a second portion of the animation. This can be effected, in an implementation, by causing the apparent size of the object 30 to increase and then decrease during the animation. This can also, or in addition, be effected by animating a "shadow" of the object 30. During the first part of the animation, the distance on the display 106 between the object 30 and the shadow increases. During the second part of the animation, the distance on the display 106 between the object 30 and the shadow decreases. In an embodiment, the animation of the motion of the object 30 is such as to give the appearance of a "gravitational force". For example, the object may appear to be dragged "down" towards a bottom portion of the display 106 during its motion. In both the described embodiments, the object 30 may appear to "land" on the second location (which may correspond to a window of a reel).

Other animation details may be provided. For example, a bounce effect may be incorporated, such that the object 30 appears to bounce after first landing on a reel, and therefore the second location is different to the apparent first landing location.

Further aspects of the method will be apparent from the above description of the system. It will be appreciated that at least part of the method will be implemented electronically, for example, digitally by a processor executing program code such as in the above description of a game controller. In this respect, in the above description certain steps are described as being carried out by a processor of a gaming system, it will be appreciated that such steps will often require a number of sub-steps to be carried out for the steps to be implemented electronically, for example due to hardware or programming limitations. For example, to carry out a step such as evaluating, determining or selecting, a processor may need to compute several values and compare those values.

As indicated above, the method may be embodied in program code. The program code could be supplied in a number of ways, for example on a tangible computer readable storage medium, such as a disc or a memory device, e.g. an EEPROM, (for example, that could replace part of memory 103) or as a data signal (for example, by transmitting it from a server). Further different parts of the program code can be executed by different devices, for example in a client server relationship. Persons skilled in the art will appreciate that program code provides a series of instructions executable by the processor.

Further modifications can be made without departing from the spirit and scope of the specification.

The invention claimed is:

1. A method of gaming performed by a gaming machine comprising at least one display and playing a game with a plurality of symbols, the method comprising:

displaying the game as a spinning reel game comprising a plurality of symbol display positions;

generating a game outcome that is awardable based on the plurality of symbols arranged on the at least one display of the gaming machine, and wherein the game outcome comprises the plurality of symbols being arranged in the plurality of symbol display positions of the spinning reel game;

displaying an object in a first location separately to the game outcome on the at least one display;

receiving an input via an input device of the gaming machine in respect of the object, and determining a second location of the object within the game outcome based at least in part on a direction of motion of the object and a strength of motion of the object received through the input;

displaying an animation of the object moving towards the second location;

causing a change of the game outcome in response to the second location corresponding to a target location in the game outcome and the object overlaying one of the plurality of symbols displayed in the target location;

presenting the object on the at least one display before the animation of the object; and presenting the game outcome in the spinning reel game on the at least one display only after initiating the animation.

2. The method of claim 1, further comprising presenting the object on the at least one display simultaneously with the spinning reel game before presenting the animation of the object.

3. The method of claim 1, wherein the at least one display includes a first display displaying the game outcome, and a second display, and further comprising initially presenting the object on the second display simultaneously with the game outcome in the spinning reel game before presenting the animation of the object.

4. The method of claim 1, wherein the target location is at least one predetermined symbol display position of the plurality of symbol display positions in the game outcome.

5. The method of claim 1, further comprising receiving a selection of the direction of motion of the object via the input device.

6. The method of claim 1, further comprising receiving a selection of the strength of motion of the object via the input device.

7. The method of claim 1, further comprising determining the second location is determined before completion of the animation.

8. The method of claim 1, further comprising determining the second location based at least in part on a random component.

9. A gaming machine playing a game with a plurality of symbols comprising:

a game controller;

a player interface; and at least one display, wherein the game controller executes instructions which cause the game controller to at least:

display to display the game as a spinning reel game comprising a plurality of symbol display positions;

generate a game outcome that is awardable based on the plurality of symbols arranged on the at least one display; and wherein the game outcome comprises the plurality of symbols being arranged in the plurality of symbol display positions of the spinning reel game display an object in a first location separately to the game outcome on the at least one display;

receive, by the player interface, an input, and in response to receiving the input, determine a second location of the object within the game outcome based at least in part on a direction of motion of the object and a strength of motion of the object received through the input;

display an animation of the object moving from the first location towards the second location;

cause a change of the game outcome in response to the second location corresponding to a target location in the game outcome and the object overlaying one of the plurality of symbols displayed in the target location; and display the object before the animation and the spinning reel game only after initiating the animation.

10. The gaming machine of claim 9, wherein the instructions, when executed, cause the at least one display to simultaneously display the object and the spinning reel game before the animation.

11. The gaming machine of claim 9, wherein the at least one display includes a first display displaying the game outcome, and a second display, and wherein the instructions, when executed, cause the second display to simultaneously present the object and the game outcome in the spinning reel game before the animation.

12. The gaming machine of claim 9, wherein the target location is at least one predetermined symbol display position of the plurality of symbol display positions in the game outcome.

13. The gaming machine of claim 9, wherein the instructions, when executed, cause the player interface to receive a selection of the direction of motion.

14. The gaming machine of claim 9, wherein the instructions, when executed, cause the player interface to receive a selection of the strength of motion.

15. The gaming machine of claim 9, wherein the at least one display comprises a touch screen, and wherein the input corresponds to a player pressing a portion of the touch screen.

16. The gaming machine of claim 9, wherein the instructions, when executed, cause the game controller to determine the second location based at least in part on a random component.

* * * * *